US011411315B2

(12) United States Patent
Onaka et al.

(10) Patent No.: US 11,411,315 B2
(45) Date of Patent: Aug. 9, 2022

(54) ANTENNA MODULE AND ANTENNA DEVICE

(71) Applicant: Murata Manufacturing Co., Ltd., Kyoto (JP)

(72) Inventors: Kengo Onaka, Kyoto (JP); Yoshiki Yamada, Kyoto (JP); Hirotsugu Mori, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 85 days.

(21) Appl. No.: 15/930,516

(22) Filed: May 13, 2020

(65) Prior Publication Data

US 2020/0274241 A1 Aug. 27, 2020

Related U.S. Application Data

(63) Continuation of application No. PCT/JP2018/040254, filed on Oct. 30, 2018.

(30) Foreign Application Priority Data

Dec. 14, 2017 (JP) ..... JP2017-239715

(51) Int. Cl.
*H01Q 5/371* (2015.01)
*H01Q 1/48* (2006.01)
(Continued)

(52) U.S. Cl.
CPC ..... *H01Q 5/371* (2015.01); *H01Q 1/48* (2013.01); *H01Q 5/378* (2015.01); *H01Q 9/0457* (2013.01); *H01Q 21/0006* (2013.01)

(58) Field of Classification Search
CPC ..... H01Q 5/371; H01Q 1/48; H01Q 21/0006; H01Q 9/0457; H01Q 5/378
See application file for complete search history.

(56) References Cited

U.S. PATENT DOCUMENTS 5,708,444 A 1/1998 Pouwels et al.
2003/0098812 A1* 5/2003 Ying ..... H01Q 19/005 343/702
(Continued)

FOREIGN PATENT DOCUMENTS

CN 105409060 * 9/2018
JP S58-59604 A 4/1983
(Continued)

OTHER PUBLICATIONS

International Search Report for PCT/JP2018/040254 dated Dec. 11, 2018.
Written Opinion for PCT/JP2018/040254 dated Dec. 11, 2018.

*Primary Examiner* — Graham P Smith
*Assistant Examiner* — Jae K Kim
(74) *Attorney, Agent, or Firm* — Pearne & Gordon LLP

(57) ABSTRACT

An antenna module includes a plurality of antenna devices. Each of the plurality of antenna devices includes a dielectric substrate on which an antenna element is placed and a feed line that transmits a radio frequency signal from a RFIC to the antenna element. The feed line is divided within the dielectric substrate and transmits a radio frequency signal to a feed point (122A-1) and a feed point (122A-2) of the antenna element, a phase of the radio frequency signal to the feed point (122A-1) and a phase of the radio frequency signal to the feed point (122A-2) being substantially opposite to one another.

18 Claims, 13 Drawing Sheets

(51) Int. Cl.

| | |
|---|---|
| ***H01Q 5/378*** | (2015.01) |
| ***H01Q 9/04*** | (2006.01) |
| ***H01Q 21/00*** | (2006.01) |

(56) References Cited

U.S. PATENT DOCUMENTS

| | | | | |
|---|---|---|---|---|
| 2004/0125021 | A1* | 7/2004 | Munk | H01Q 9/0407 343/700 MS |
| 2005/0057416 | A1 | 3/2005 | Yuanzhu | |
| 2008/0129636 | A1 | 6/2008 | Surittikul et al. | |
| 2016/0261039 | A1* | 9/2016 | Parsche | H01Q 9/0407 |
| 2017/0222316 | A1 | 8/2017 | Mizunuma et al. | |

FOREIGN PATENT DOCUMENTS

| | | | | | |
|---|---|---|---|---|---|
| JP | S58-59605 | A | | 4/1983 | |
| JP | S63-120502 | A | | 5/1988 | |
| JP | H09-148840 | A | | 6/1997 | |
| JP | 2001-007631 | A | | 1/2001 | |
| JP | 2001-044753 | A | | 2/2001 | |
| JP | 2001044753 | A | * | 2/2001 | H01Q 1/38 |
| JP | 2005-079968 | A | | 3/2005 | |
| JP | 2008-141765 | A | | 6/2008 | |
| JP | 2008-199113 | A | | 8/2008 | |
| WO | WO-2007046134 | A1 | * | 4/2007 | H01Q 9/16 |
| WO | 2016/063759 | A1 | | 4/2016 | |

* cited by examiner

| ELEVATION ($\phi$) | $\phi = +45°$ | |
|---|---|---|
| |  | |
| COMPARISON EXAMPLE |  | |
| PEAK GAIN | H DIRECTION | V DIRECTION |
| | 5.2dBi | 13.6dBi |
| EMBODIMENT |  | |
| PEAK GAIN | H DIRECTION | V DIRECTION |
| | -81.8dBi | 14.3dBi |

ANTENNA MODULE AND ANTENNA DEVICE

This is a continuation of International Application No. PCT/JP2018/040254 filed on Oct. 30, 2018 which claims priority from Japanese Patent Application No. 2017-239715 filed on Dec. 14, 2017. The contents of these applications are incorporated herein by reference in their entireties.

BACKGROUND

Technical Field

The present disclosure relates to antenna modules and antenna devices and more particularly to technologies that improve antenna characteristics in antenna devices and antenna modules.

International Publication No. 2016/063759 (Patent Document 1) discloses a wireless communication module in which an antenna element and a radio frequency semiconductor element are unified.

In the wireless communication module described in the Patent Document 1, a feed line is provided to transmit a radio frequency signal from the radio frequency semiconductor element to the antenna element. In wireless communication modules having such a configuration, to match impedances of the antenna element and the feed line, a feed point to which the feed line is connected is often placed at a position shifted away from a central part of the antenna element which serves as a radiation electrode.

Patent Document 1: International Publication No. 2016/063759

BRIEF SUMMARY

An antenna array in which a plurality of the antenna elements, such as described in the Patent Document 1 are arranged in a matrix shape is known in the art. In such antenna array, the directivity of antenna can be inclined by creating a phase difference between adjacent antenna elements.

In the case where the feed point is placed at a position shifted away from the central part of the antenna element as described above, generally, the antenna element radiates a radio wave being excited along the direction connecting this feed point and the central part of the antenna element. At this time, a radio wave having the same frequency as that of the radio wave radiated from the antenna element leaks from the feed line connected to the antenna element, and this radio wave is excited along the extending direction of the feed line. As a result, when the directivity of antenna is inclined in the antenna array in which a plurality of the antenna elements are arranged in an array, depending on an inclination direction, the radio wave radiated from the antenna element and the radio wave leaked from the feed line interfere to each other. This may cause deviation of peak gain and degradation of communication quality.

The present disclosure suppresses the degradation of communication quality in an antenna device and an antenna module.

An antenna module according to the present disclosure includes a plurality of antenna devices. Each of the plurality of antenna devices includes a dielectric substrate on which an antenna element is placed and a first feed line that transmits a radio frequency signal from a radio frequency element to the antenna element. The first feed line is divided within the dielectric substrate and transmits a radio frequency signal to a first feed point and a second feed point of the antenna element, a phase of the radio frequency signal to the first feed point and a phase of the radio frequency signal to the second feed point being substantially opposite to one another.

Each of the plurality of antenna devices can further include a ground electrode provided opposite the antenna element. The first feed line is divided at a layer inside the dielectric substrate, the layer being closer to the antenna element than the ground electrode. A first line length of the first feed line from the radio frequency element to the first feed point is different from a second line length of the first feed line from the radio frequency element to the second feed point.

Each of the plurality of antenna devices can further include a ground electrode provided opposite the antenna element. The first feed line is divided at a layer inside the dielectric substrate, the layer being further away from the antenna element than the ground electrode. A first line length of the first feed line from the radio frequency element to the first feed point is different from a second line length of the first feed line from the radio frequency element to the second feed point.

In a plan view of the antenna element viewed along a thickness direction of the dielectric substrate, the first feed point and the second feed point can be arranged in approximate symmetry with respect to a hypothetical line passing through a center of the antenna element.

In the plan view of the antenna element viewed along the thickness direction of the dielectric substrate, the antenna element can include a third feed point and a fourth feed point arranged along a direction of the hypothetical line in approximate symmetry with respect to the center of the antenna element. Each of the plurality of antenna devices further includes a second feed line that transmits a radio frequency signal from the radio frequency element to the third feed point and the fourth feed point. A third line length of the second feed line from the radio frequency element to the third feed point is different from a fourth line length of the second feed line from the radio frequency element to the fourth feed point.

The first feed line can be divided at a first layer of the dielectric substrate, and the second feed line can be divided at a second layer of the dielectric substrate. Each of the plurality of antenna devices further includes another ground electrode placed between the first layer and the second layer.

The antenna element can be placed inside the dielectric substrate. Each of the plurality of antenna devices further includes a parasitic element, the parasitic element being placed opposite the antenna element at a position closer to a surface of the dielectric substrate than the antenna element.

The antenna module can further include the radio frequency element described above. In a plan view of the antenna module viewed along a thickness direction of the dielectric substrate, the radio frequency element and at least part of a plurality of the antenna elements included in the plurality of antenna devices are arranged in such a manner as to overlap one another.

An antenna device according to another aspect of the present disclosure includes a dielectric substrate on which an antenna element is placed and a feed line that transmits a radio frequency signal from a radio frequency element to the antenna element, the radio frequency element supplying a radio frequency signal to the antenna element. The feed line is divided within the dielectric substrate and transmits a radio frequency signal to a first feed point and a second feed point of the antenna element, a phase of the radio frequency signal to the first feed point and a phase of the radio frequency signal to the second feed point being substantially opposite to one another.

An antenna module according to still another aspect of the present disclosure includes a plurality of antenna devices. Each of the plurality of antenna devices includes a dielectric substrate on which an antenna element is placed and a feed line that transmits a radio frequency signal from a radio frequency element to the antenna element. The feed line includes a first line that transmits a radio frequency signal to a first feed point of the antenna element and a second line that transmits a radio frequency signal to a second feed point of the antenna element. The second line receives a radio frequency signal from the first line by electromagnetically coupling with the first line within the dielectric substrate and transmits the radio frequency signal to the second feed point, a phase of the radio frequency signal to the second feed point being substantially opposite to a phase of the radio frequency signal to the first feed point.

An antenna device according to still another aspect of the present disclosure includes a dielectric substrate on which an antenna element is placed and a feed line that transmits a radio frequency signal from a radio frequency element to the antenna element. The feed line includes a first line that transmits a radio frequency signal to a first feed point of the antenna element and a second line that transmits a radio frequency signal to a second feed point of the antenna element. The second line receives a radio frequency signal from the first line by electromagnetically coupling with the first line within the dielectric substrate and transmits the radio frequency signal to the second feed point, a phase of the radio frequency signal to the second feed point being substantially opposite to a phase of the radio frequency signal to the first feed point.

According to the present disclosure, the feed line for supplying a radio frequency signal from the radio frequency element to the antenna element is divided within the dielectric substrate, and the radio frequency signal is supplied to two feed points of the antenna element with a phase difference therebetween. This reduces radio waves leaking from the feed lines connected to the two feed points by allowing at least part of these radio waves to have cancelled each other out. Accordingly, the effect on the radio wave radiated from the antenna element can be reduced, and the degradation of communication quality can be suppressed.

DETAILED DESCRIPTION

Figure 1:
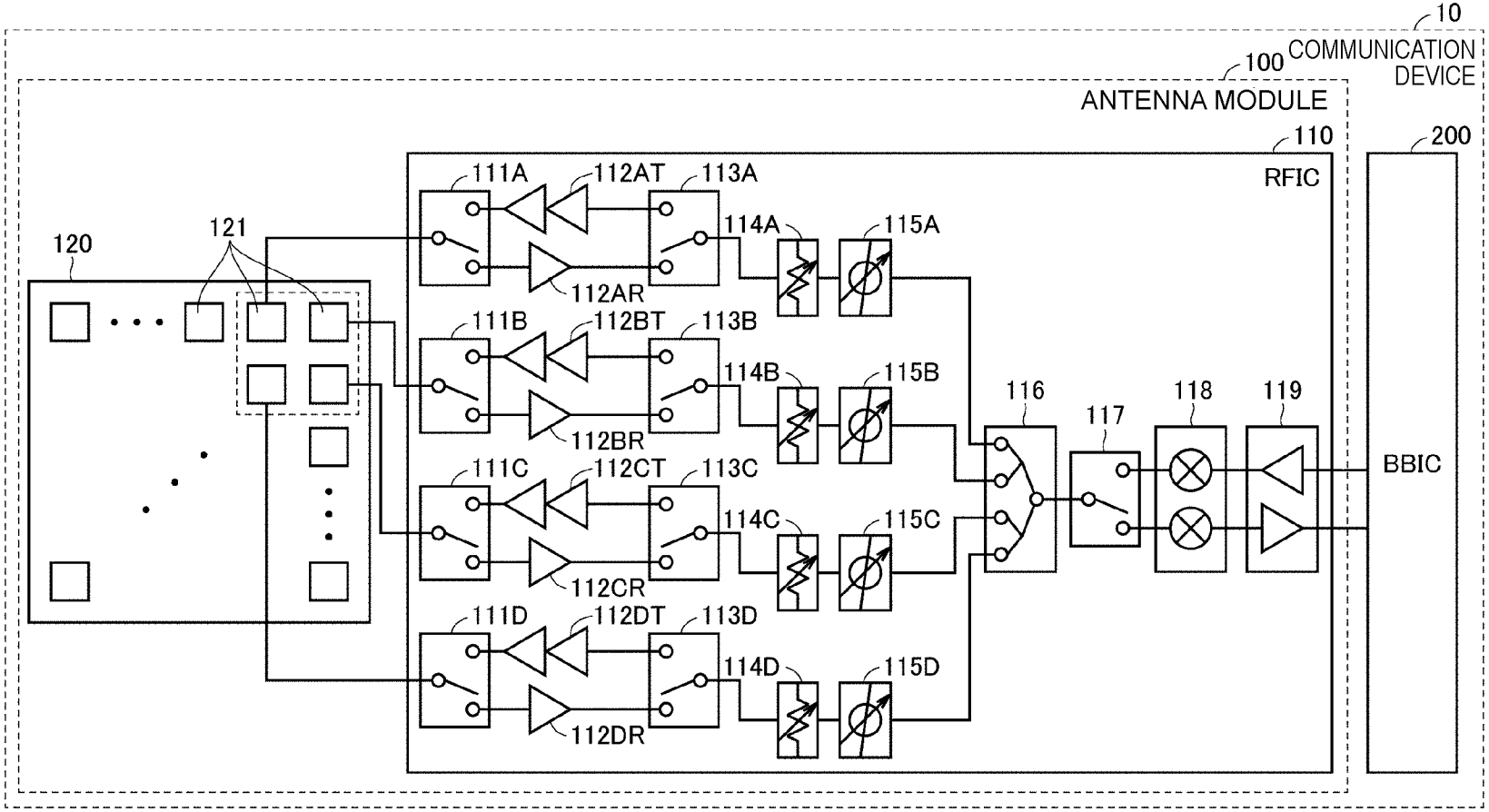
FIG. 1 is a block diagram of a communication device to which an antenna module is applied.

Hereinafter, embodiments of the present disclosure will be described in detail while referring to the drawings. Note that the same reference numerals are assigned to the same or corresponding portions in the drawings, and description thereof will not be repeated.

Embodiment 1

(Basic Configuration of Communication Device)

FIG. 1 is a block diagram of an example of a communication device 10 to which an antenna module according to the present embodiment is applied. The communication device 10 may be, for example, a mobile phone, a mobile terminal, such as a smartphone, a tablet, or the like, or a personal computer with a communication function.

Referring to FIG. 1, the communication device 10 includes an antenna module 100 and a BBIC 200 that constitutes a base-band signal processing circuit. The antenna module 100 includes a radio frequency integrated circuit (RFIC) 110 or like radio frequency processing circuit, which is one example of the radio frequency element, and an antenna array 120. The communication device 10 up-converts a signal transmitted from the BBIC 200 to the antenna module 100 into a radio frequency signal and radiates from the antenna array 120, and further down-converts a radio frequency signal received by the antenna array 120 and performs signal processing at the BBIC 200.

Note that in FIG. 1, for the sake of brevity, of a plurality of antenna elements 121 that constitutes the antenna array 120, only a configuration corresponding to four antenna elements (radiation conductors) 121 is illustrated, and configurations corresponding to other antenna elements 121 configured in a similar manner are omitted.

The RFIC 110 includes switches 111A to 111D, 113A to 113D, and 117, power amplifier 112AT to 112DT, low noise amplifiers 112AR to 112DR, attenuators 114A to 114D, phase shifters 115A to 115D, a signal multiplexer/demultiplexer 116, a mixer 118, and an amplifier circuit 119.

When a radio frequency signal is transmitted, the switches 111A to 111D and 113A to 113D are switched to the power amplifiers 112AT to 112DT sides, and the switch 117 is connected to a transmitting side amplifier of the amplifier circuit 119. When a radio frequency signal is received, the switches 111A to 111D and 113A to 113D are switched to the low noise amplifiers 112AR to 112DR sides, and the switch 117 is connected to a receiving side amplifier of the amplifier circuit 119.

A signal transmitted from the BBIC 200 is amplified at the amplifier circuit 119 and up-converted at the mixer 118. A transmitting signal that is an up-converted radio frequency signal is split into four signals at the signal multiplexer/demultiplexer 116 and respectively fed to different antenna elements 121 after passing through four signal paths. At this time, the directivity of the antenna array 120 can be adjusted by individually adjusting the degree of phase shift in the phase shifters 115A to 115D placed in the respective signal paths.

Further, received signals, which are radio frequency signals received by the respective antenna elements 121, are transmitted via four different signal paths, multiplexed at the signal multiplexer/demultiplexer 116, down-converted at the mixer 118, amplified at the amplifier circuit 119, and transmitted to the BBIC 200.

The RFIC 110 is formed as, for example, a one-chip integrated circuit component including the circuit configuration described above. Alternatively, devices (switches, power amplifiers, low noise amplifiers, attenuators, and phase shifters) corresponding to each antenna element 121 in the RFIC 110 may be formed as a one-chip integrated circuit component for each antenna element 121.

(Explanation on Polarization Direction)

Figure 2:
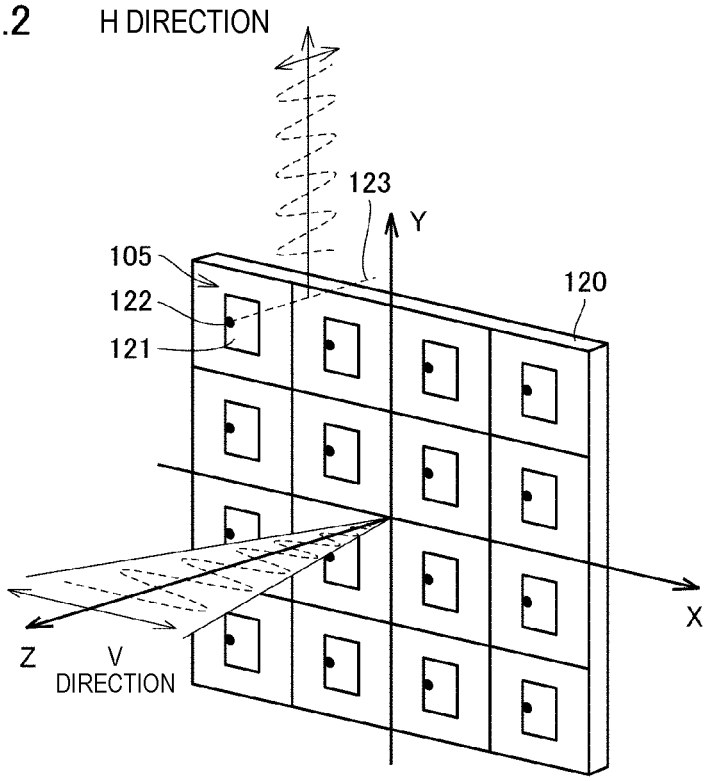
FIG. 2 is a diagram illustrating polarization generated in an antenna module.

FIG. 2 is a diagram illustrating polarization generated in the antenna module 100. In FIG. 2, the antenna array 120 is described using an example in which antenna devices 105 each including the antenna element 121 are arranged in a 4×4 matrix form. In FIG. 2, the plane on which each antenna device 105 is arranged is the X-Y plane, and the direction perpendicular to the antenna device 105 is the Z axis.

In each antenna element 121, a feed line 123 from the RFIC 110 is connected to a feed point 122. The impedance is minimum at the central part of each antenna element 121. Thus, in order to match at 50Ω, the feed point 122 is placed at an offset position shifted from the center of each antenna element 121 to the negative direction of the X axis. In the case where the feed point 122 is placed in such a position, each antenna element radiates a radio frequency signal (radio wave) having a polarization excited along the X axis direction (V direction in the drawing) and is parallel to the Z-X plane.

Figure 3:
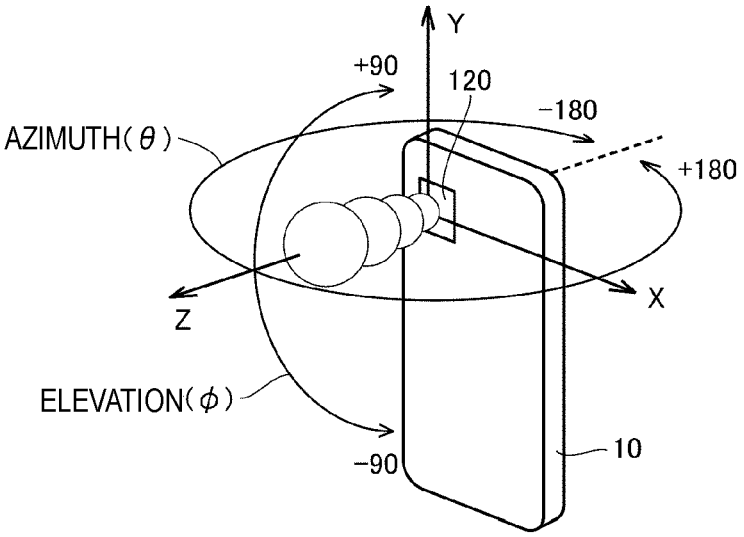
FIG. 3 is a diagram illustrating an inclination direction of directivity in an example in which an antenna module according to an embodiment is installed in a mobile terminal.

The phases of radio frequency signals radiated from adjacent antenna elements 121 are shifted relative to each other by adjusting the degree of phase shift between the antenna elements 121 adjacent to each other in the X axis direction. This enables to incline the directivity by rotating a radio frequency signal radiated from the whole of the antenna module 100 about the Y axis. This inclination of the directivity about the Y axis is referred to as "Azimuth" (FIG. 3) and is denoted by θ in the present specification. Further, by adjusting the degree of phase shift between the antenna elements 121 adjacent to each other in the Y axis direction, a radio frequency signal being radiated can be rotated about the X axis, and thus the directivity can be inclined. This inclination of the directivity about the X axis is referred to as "Elevation" (FIG. 3) and is denoted by ϕ in the present specification.

The feed line 123 is connected to the antenna element 121 from the backside (In FIG. 2, the negative side of the Z-axis) of the antenna array 120, which will be described below. The feed line 123 sometimes functions like an antenna that radiates a radio wave excited in the direction (H direction in FIG. 2) along the feed line 123 when a radio frequency signal is being transmitted.

Figure 4A:
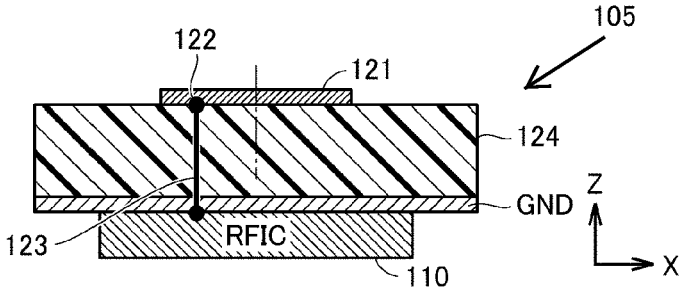
FIG. 4A is a cross-sectional view of an antenna device of a comparison example.
Figure 4B:
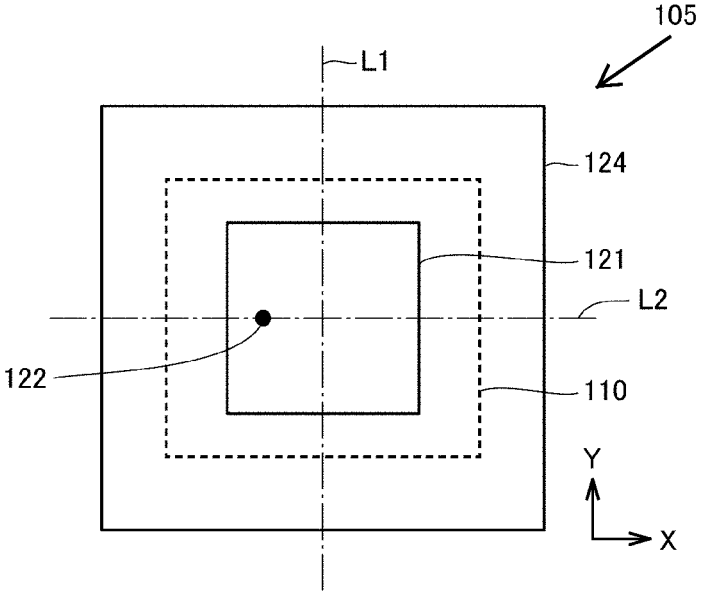
FIG. 4B is a plan view of the antenna device of the comparison example.

FIG. 4A and FIG. 4B (hereinafter, also collectively referred to as "FIG. 4") are a cross-sectional view and a plan view of the antenna device 105 illustrated in FIG. 2, respectively. The antenna device 105 illustrated in FIG. 4 is illustrated as a comparison example of an antenna device according to the present embodiment.

The antenna device 105 includes, in addition to the RFIC 110 described above, the antenna element 121, and the feed line 123, a ground electrode GND placed opposite the dielectric substrate 124 and the antenna element 121. Note that the antenna device 105 may not include the RFIC 110. That is to say, the RFIC 110 may be an external component for the antenna device 105.

The dielectric substrate 124 is a multilayer substrate in which a plurality of dielectric layers is stacked on top of each other. The dielectric substrate 124 is composed of, for example, Low Temperature Co-fired Ceramics (LTCC). Note that the shape of the dielectric substrate 124 is not limited to a flat-plate shape and may alternatively be a shape at least part of which is bent.

The antenna element 121 is placed on one of the surfaces of the dielectric substrate 124, and the RFIC 110 is mounted on the other surface of the dielectric substrate 124. The ground electrode GND is placed between the dielectric substrate 124 and the RFIC 110. Note that the RFIC 110 is mounted on a substrate or the like, which is different from the dielectric substrate 124, and that the substrates and the like on which the dielectric substrate 124 and the RFIC 110 are respectively mounted may be connected, for example, via a cable or another substrate. Alternatively, the RFIC 110 may be provided within the dielectric substrate 124.

In the plan view in a direction from the antenna element 121 to the RFIC 110, that is, the thickness direction of the dielectric substrate 124 (Z-axis direction in the drawing), the antenna element 121 is formed, for example, in a rectangular flat-plate shape. Note that the shape of the antenna element 121 is not limited to a rectangular shape and may be, for example, a shape like a circle or a regular polygon.

The feed line 123 is formed as, for example, a metal via penetrating through the dielectric substrate 124 and the ground electrode GND. In order to match impedances of the antenna element 121 and the feed line 123 at the central part of the antenna element 121, the feed line 123 is connected to the antenna element 121 at the feed point 122 placed at an offset position shifted from the center of the antenna element 121.

In the antenna device 105 of the comparison example, such as this, as illustrated in FIG. 2, a radio wave having a polarization excited along the extending direction of the feed line 123, that is, the thickness direction of the antenna array 120 leaks from the feed line 123. In the case where the polarization of the radio wave radiated from the antenna element 121 and the polarization of the radio wave leaked from the feed line 123 are orthogonal to each other, there is almost no effect of the radio wave from the feed line 123 on the radio wave radiated from the antenna element 121. Whereas, when the directivity is inclined in the azimuth direction by adjusting the degree of phase shift between the antenna elements 121 adjacent to each other in the X axis direction, the polarization of a radio wave radiated from the whole of the antenna array 120 inclines, and a component in the thickness direction of the antenna array 120 is formed. In particular, this polarization component in the thickness direction increases as the inclination increases. When this happens, there may be the effect of the radio wave leaked from the feed line 123 on the radio wave radiated from the whole of the antenna array 120.

As illustrated in FIG. 2 and FIG. 4, in the case where the feed line 123 is placed at an offset location shifted to the negative direction of the X axis, when the directivity is inclined in the negative direction of the azimuth, the effect of a radio wave leaked from the feed line 123 is greater, compared to the case where the directivity is inclined in the positive direction of the azimuth. That is to say, the peak gain may be uneven depending on the inclination direction of the directivity.

In view of the above, the present embodiment employs a system in which the feed line 123 that supplies a radio frequency signal from the RFIC 110 to the antenna element 121 is divided within the dielectric substrate 124 and the radio frequency signal is supplied to the antenna element 121 via two feed points. More specifically, a radio frequency signal whose phase is reversed with respect to that of a radio frequency signal supplied to one of feed points is supplied to the other feed point. This enables to reduce the effect on the radio wave radiated from the antenna element 121 by causing interference between the radio waves leaked from two feed lines and cancelling each other out. Accordingly, even when the directivity of antenna is inclined, the difference between the peak gains caused depending on the inclination direction can be reduced, and the peak gains can be equalized.

Figure 5A:
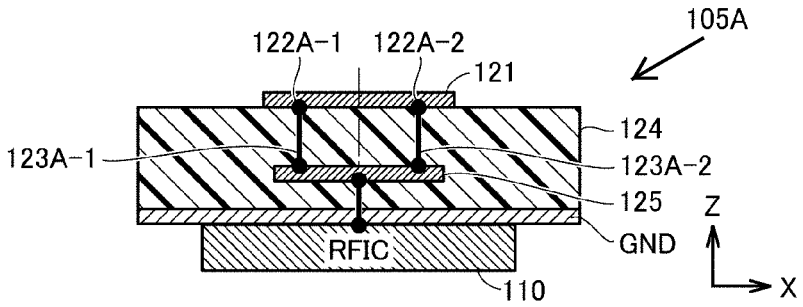
FIG. 5A is a cross-sectional view of an antenna device according to an embodiment 1.
Figure 5B:
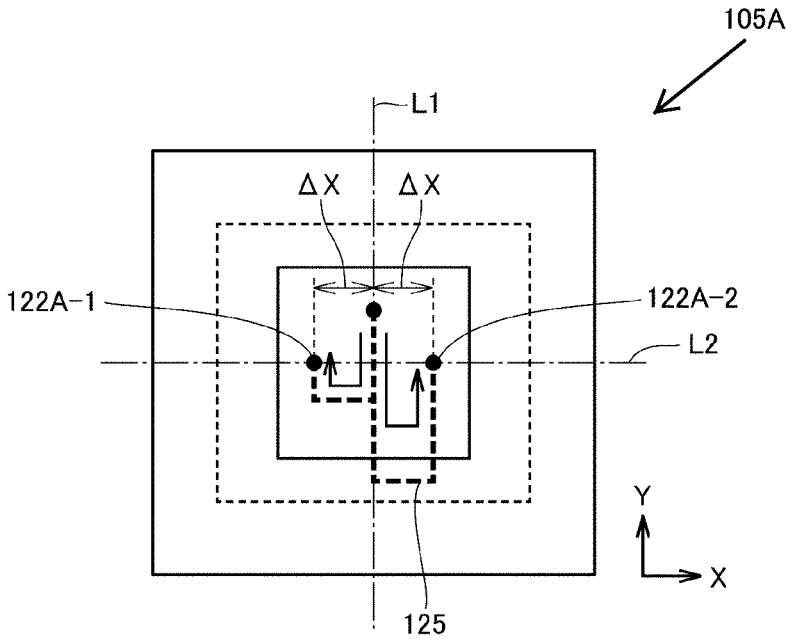
FIG. 5B is a plan view of the antenna device according to the embodiment 1.
Figure 6:
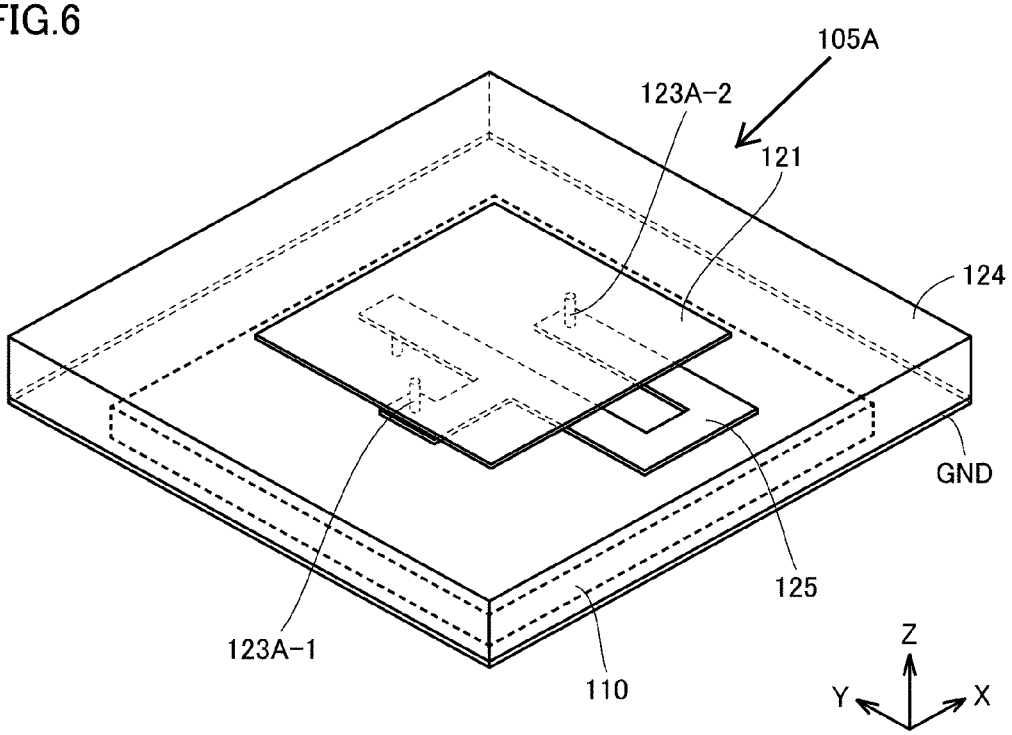
FIG. 6 is a perspective view of the antenna device of FIG. 5.

FIG. 5A and FIG. 5B (hereinafter, also collectively referred to as "FIG. 5") are a cross-sectional view and a plan view of an antenna device 105A according to the embodiment 1, respectively. Further, FIG. 6 is a perspective view of the antenna device 105A of FIG. 5. In the antenna device 105A of FIG. 5, a feed line connecting the RFIC 110 and the antenna element 121 is divided into two on a phase difference formation plane 125 placed inside the dielectric substrate 124, and one of the feed lines, a feed line 123A-1, is connected to a feed point 122A-1, and the other feed line 123A-2 is connected to a feed point 122A-2. Note that the phase difference formation plane 125 is placed on a layer of the dielectric substrate 124, and this layer is closer to the antenna element 121 than the ground electrode GND.

As illustrated in the plan view of FIG. 5, the phase difference formation plane 125 is formed between the antenna element 121 and the ground electrode GND as a wiring pattern having lines of different lengths. In the example of FIG. 5, the wiring pattern is formed in such a way that the line length to the feed point 122A-2 is longer than the line length to the feed point 122A-1. This difference in line length causes a phase difference between radio frequency signals supplied to these two feed points. The line lengths can be determined in such a way that the radio frequency signals supplied to these two feed points are in opposite phase. Note that the radio frequency signals supplied to these two feed points are not necessarily in complete opposite phases and may be in substantially opposite phases. The substantially opposite phase in the present specification includes a phase difference in the range of 180 degrees±10 degrees.

The feed point 122A-1 is placed at a position separated from the center of the rectangular antenna element 121 with a distance of ΔX in the negative direction of the X axis. Whereas, the feed point 122A-2 is placed at a position separated from the center of the antenna element 121 with a distance of ΔX in the positive direction of the X axis. That is to say, these two feed points 122A-1 and 122A-2 are arranged in symmetry with respect to a hypothetical line L1 that passes through the center of antenna element 121 and is parallel to the Y axis direction.

Such configuration causes radio waves leaked from these two feed lines 123A-1 and 123A-2 to have opposite phase. This causes the interference between these radio waves and the cancellation of these radio waves. This enables to reduce the effect on the radio wave radiated from the antenna element 121.

Figure 7:
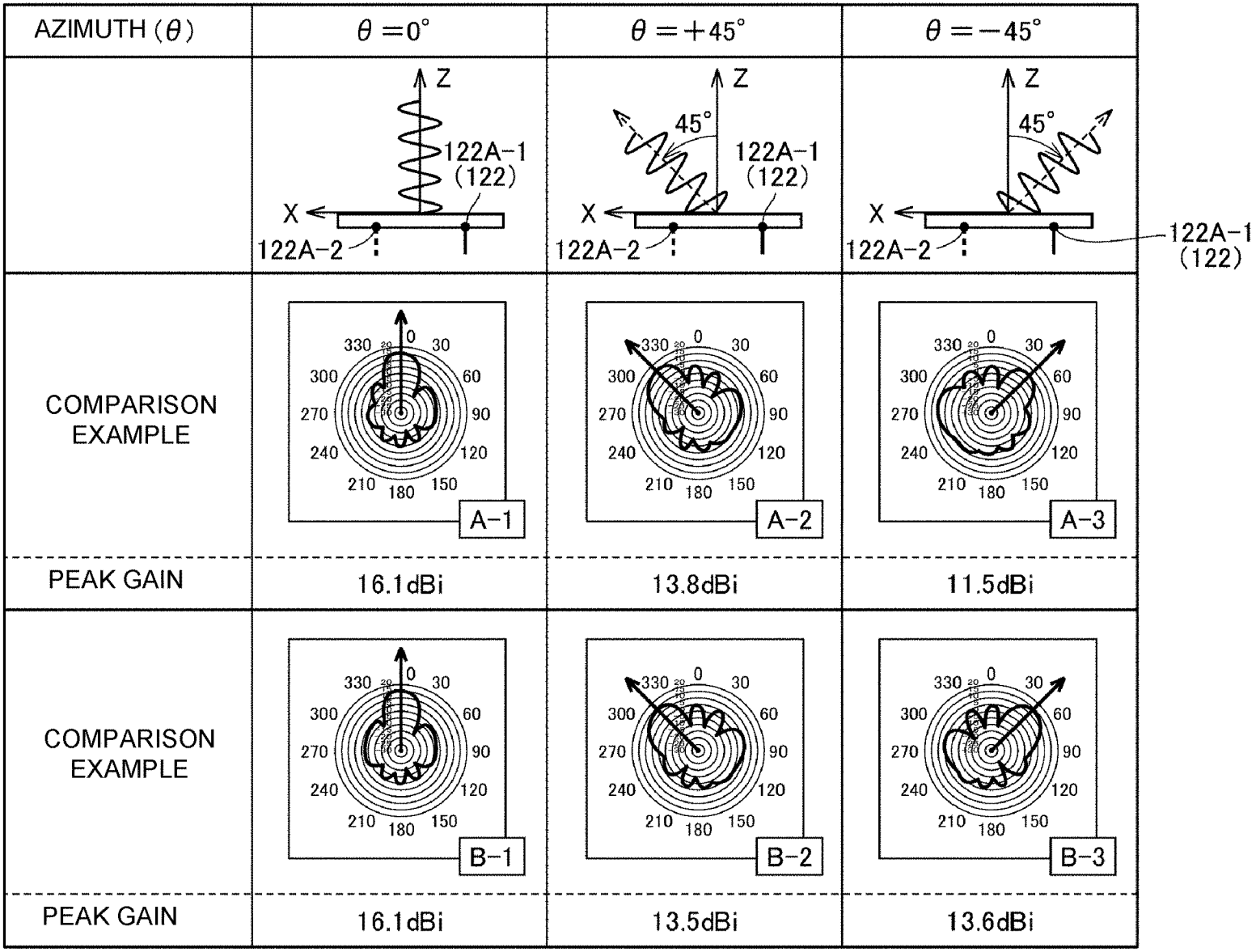
FIG. 7 is simulation results of peak gains of the antenna modules of the comparison example and the embodiment 1 when the directivity is inclined in a left-right direction (azimuth direction).
Figure 8:
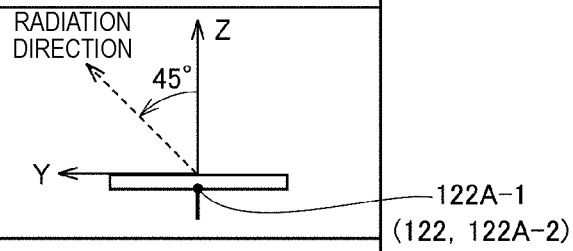
FIG. 8 is simulation results of peak gains of the antenna modules of the comparison example and the embodiment 1 when the directivity is inclined in an up-down direction (elevation direction).
Figure 8:
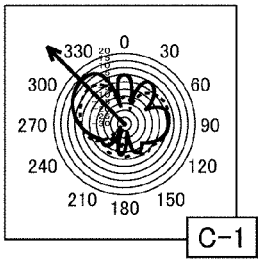
Figure 8:
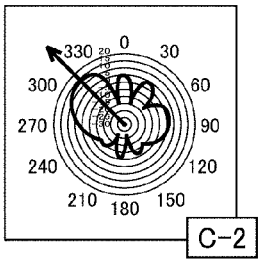

FIG. 7 and FIG. 8 are diagrams illustrating simulation results of characteristics when the directivity of a 4×4 antenna array, such as the one illustrated in FIG. 2 is inclined in the comparison example of FIG. 4 and the embodiment 1 of FIG. 5. FIG. 7 is simulation results for the cases of inclinations of +45 degrees and −45 degrees in the azimuth direction. Further, FIG. 8 is simulation results for the case of an inclination of +45 degrees in the elevation direction.

First, referring to FIG. 7, when the azimuth θ=0 degree, the antenna array 120 radiates a radio wave having the polarization in the Z axis direction. When the azimuth θ=+45 degrees, a radio wave having the polarization inclined to a direction of 45 degrees to the positive side of the X axis from the Z axis is radiated. Further, when the azimuth θ=−45 degrees, a radio wave having the polarization inclined to a direction of 45 degrees to the negative side of the X axis from the Z axis is radiated. Each chart of the comparison example and the embodiment in FIG. 7 illustrates the peak gain in the Z-X plane, and the arrow direction is the inclination direction of polarization.

When the azimuth θ=0 degree, there is no effect of the feed line on the radio wave radiated from the antenna element 121 in both the comparison example and the embodiment, and the peak gain is 16.1 dBi (Charts A-1 and B-1).

When the azimuth θ=+45 degrees, in the comparison example, the inclination direction of the polarization of the radio wave radiated from the whole of the antenna array 120 is the opposite direction of the feed line 123, and thus the effect of the radio wave leaked from the feed line 123 is small, and the peak gain is 13.8 dBi (Chart A-2). Further, in the case with the embodiment, the inclination direction of the polarization of the radio wave radiated from the antenna array 120 is the same as the direction of the polarization of the radio wave leaked from the feed line 123A-2. However, there is the interference between the radio wave from the feed line 123A-1 and the radio wave from the feed line 123A-2, and this interference causes these radio waves to be cancelled out. Thus, the peak gain is 13.5 dBi and is comparable to that of the comparison example (Chart B-2).

Whereas, when the azimuth θ=−45 degrees, in the comparison example, the side lobe becomes greater due to the effect of the polarization of the radio wave leaked from the feed line 123, and the peak gain decreases to 11.5 dBi (Chart A-3). Whereas, in the embodiment, the peak gain is 13.6 dBi, and thus substantially the same gain as in the case with the azimuth θ=+45 degrees can be retained (Chart B-3).

As described above, by supplying radio frequency signals having opposite phases to the two feed points, the peak gain can be equalized even when the directivity is inclined in the azimuth direction, and the antenna characteristic can be improved.

Next, referring to FIG. 8, when the elevation ϕ=+45 degrees, the antenna array 120 radiates a radio wave having the polarization inclined to a direction of 45 degrees to the positive side of the Y axis from the Z axis. Each chart of FIG. 8 illustrates the peak gain (solid line) of a radio wave in the V direction (FIG. 2) in the Y-Z plane and the peak gain (dashed line) of a radio wave in the H direction (FIG. 2) in the Y-Z plane.

In the comparison example, the peak gain in the V direction of the radiation direction is 13.6 dBi, and the peak gain in the H direction is 5.2 dBi (Chart C-1). Thus, a polarization component from the feed line 123 appears in the radiation direction. That is to say, in the radiation direction, isolation between the polarization in the V direction and the polarization in the H direction is not achieved properly, and so-called Cross Polarization Discrimination (XPD) decreases.

Whereas, in the embodiment, the peak gain in the V direction of the radiation direction is 14.3 dBi, whereas the peak gain in the H direction is −81.8 dBi (Chart C-2). It clearly illustrates that isolation of the polarization in the H direction of the radiation direction is sufficiently achieved. Note that in Chart C-2, the polarization in the H direction is concentrated to a central part of the chart and cannot be discriminated.

As described above, by supplying radio frequency signals having substantially opposite phases to the two feed points of the antenna element, a predetermined level of peak gain can be retained and equalization of the peak gain can be achieved, thereby enabling to suppress the degradation of XPD, even when the directivity is inclined either in the azimuth direction or in the elevation direction. Accordingly, it becomes possible to improve the communication quality when the directivity is inclined.

Embodiment 2

In the embodiment 1, the configuration is described in which the phase difference formation plane is formed between the antenna element and the ground electrode. In general, the bandwidth (in other words, antenna characteristic) of a radio frequency signal is determined by the thickness of a dielectric placed between the ground electrode and the antenna element that serves as a radiation electrode. In the configuration of the embodiment 1, because the phase difference formation plane is formed between the antenna element and the ground electrode (antenna area), the peak gains for different directivity inclinations can be equalized while maintaining the size of an antenna module (in other words, while maintaining a low profile thereof). Whereas, in the case where the phase difference formation plane is provided inside the antenna area, there is a possibility that an electromagnetic field generated from the phase difference formation plane affects the antenna characteristic to a certain degree.

In the embodiment 2, an exemplary configuration is described in which the phase difference formation plane is placed outside the antenna area between the ground electrode and the RFIC. According to this, the size of the antenna module may increase to a certain degree because of a thicker dielectric substrate. However, this enables to insulate the antenna area and the phase difference formation plane, thereby enabling to reduce the effect on the antenna characteristic.

Figure 9A:
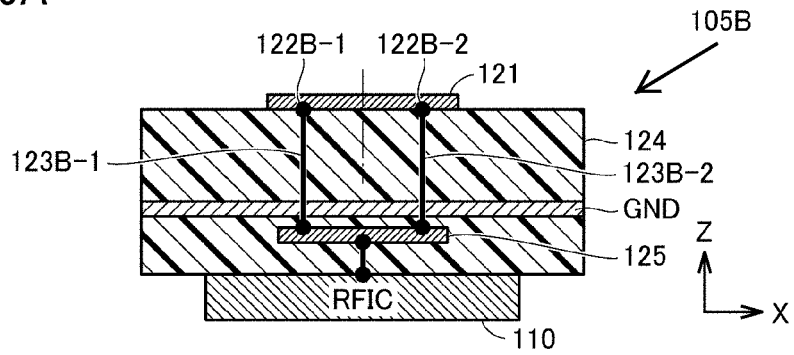
FIG. 9A is a cross-sectional view of an antenna device according to an embodiment 2.
Figure 9B:
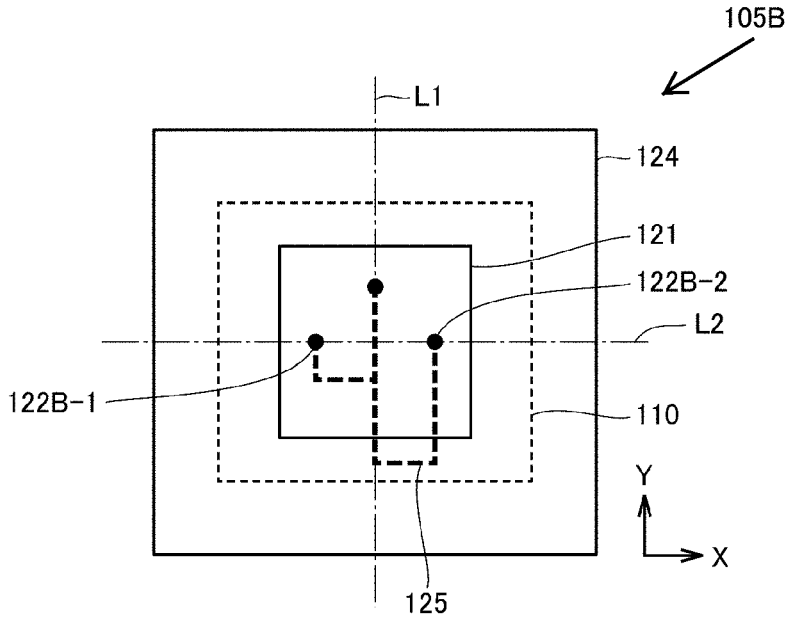
FIG. 9B is a plan view of the antenna device according to the embodiment 2.

FIG. 9A and FIG. 9B (hereinafter, also collectively referred to as "FIG. 9") are a cross-sectional view and a plan view of an antenna device 105B according to the embodiment 2, respectively. Referring to FIG. 9, in the antenna device 105B, the ground electrode GND is formed on an intermediate layer of the dielectric substrate 124, and the phase difference formation plane 125 is formed inside the dielectric substrate 124 between this ground electrode GND and the RFIC 110. That is to say, the phase difference formation plane 125 is placed on a layer of the dielectric substrate 124, and this layer is positioned further away from the antenna element 121 than the ground electrode GND. The configuration other than the above is similar to that of the embodiment 1, and the description thereof will not be repeated.

In the embodiment 2, the line lengths from the RFIC 110 to respective feed points 122B-1 and 122B-2 are also determined in such a way that the phase of a radio frequency signal supplied to the feed point 122B-1 and the phase of a radio frequency signal supplied to the feed point 122B-2 are substantially opposite to each other.

As described above, by placing the phase difference formation plane 125 outside the antenna area between the ground electrode and the RFIC, the peak gains for different directivity inclinations can be equalized while reducing the effect on the antenna characteristic.

Modification Example 1

In the embodiment described above, the configuration is described in which the antenna element is formed on a surface of the dielectric substrate. However, the antenna element may be formed within the dielectric substrate.

Figure 10:
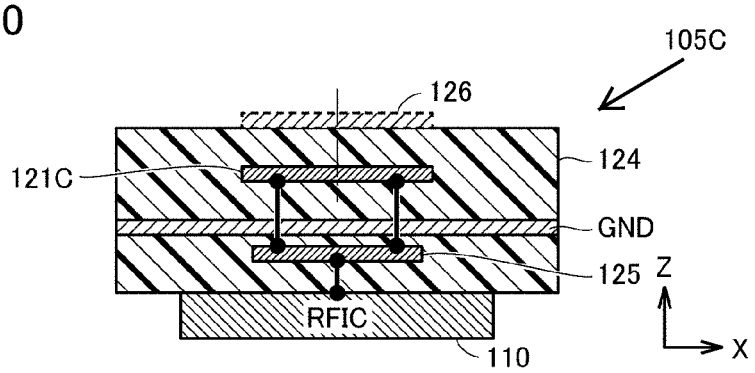
FIG. 10 is a cross-sectional view of an antenna device according to a modification example 1.

FIG. 10 is a cross-sectional view of an antenna device 105C according to the modification example 1. In the antenna device 105C of FIG. 10, an antenna element 121C is formed on an internal layer of the dielectric substrate 124, and the rest of the configuration is similar to that of FIG. 9.

As described above, by providing the antenna device 105C within the dielectric substrate 124, the line lengths of feed lines connecting the phase difference formation plane 125 and the antenna element 121C become shorter compared to the embodiment described above, thereby enabling to hamper the generation of polarization from the feed lines.

Further, as illustrated by the dashed line in FIG. 10, a parasitic element 126 may be further provided on a surface of the dielectric substrate 124 opposite the antenna element 121C. Providing the parasitic element 126 enables to widen the bandwidth of a radio frequency signal. Note that the parasitic element 126 is not necessarily placed on the surface of the dielectric substrate 124 as illustrated in FIG. 10, and may alternatively be placed within the dielectric substrate 124 so long as the position of the parasitic element 126 is closer to a surface of the dielectric substrate 124 than the antenna element 121.

Modification Example 2

In the embodiments described above, two feed points are placed on a hypothetical line L2 in the X axis direction, which passes through the center of the antenna element. However, these feed points may alternatively be placed at positions shifted slightly away from the hypothetical line L2.

Figure 11:
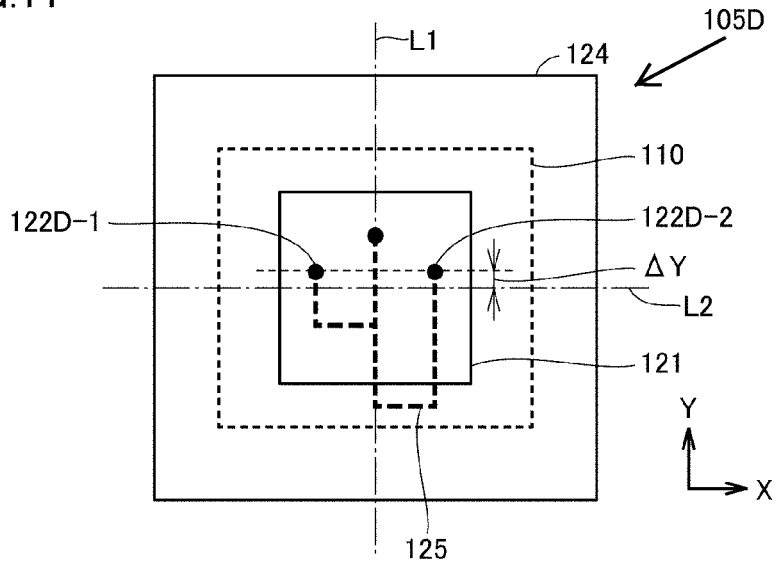
FIG. 11 is a plan view of an antenna device according to a modification example 2.

FIG. 11 is a plan view of an antenna device 105D according to the modification example 2. In FIG. 11, two feed points 122D-1 and 122D-2 are placed at offset position shifted from the hypothetical line L2 in the X axis direction, which passes through the center of the antenna element, to the Y axis direction by ΔY. Note that in consideration of points relating to degradation of antenna characteristics and the like, the offset amount of ΔY can be equal to or less than λ/20, where λ is the wavelength of a radio frequency signal.

As described above, relaxing the limitation on the arrangement of the feed points enables the improvement of flexibility in design and the reduction of production cost.

Modification Example 3

In the embodiments described above, two feed points are arranged in symmetry with respect to the hypothetical line L1 in the Y axis direction that passes through the center of the antenna element. However, these feed points may not be necessarily arranged in perfect symmetry with respect to the hypothetical line L1 and may alternatively be arranged in approximate symmetry.

Figure 12:
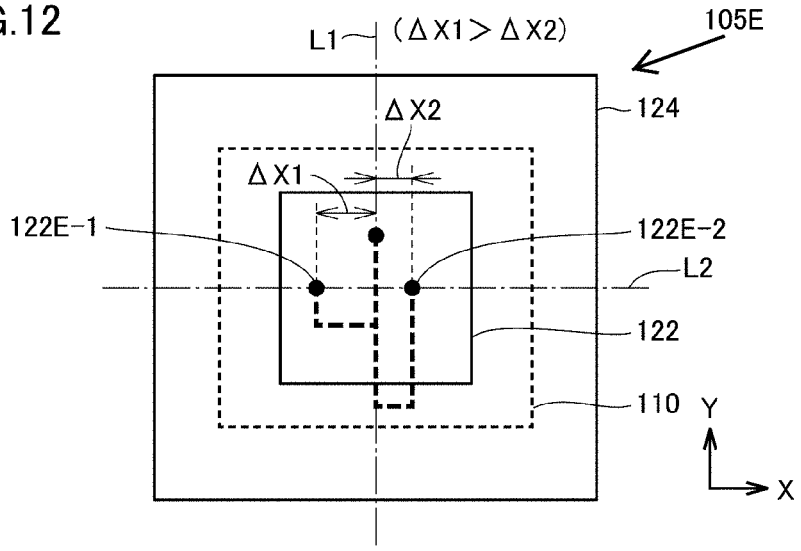
FIG. 12 is a plan view of an antenna device according to a modification example 3.

FIG. 12 is a plan view of an antenna device 105E according to a modification example 3. In the example of FIG. 12, a feed point 122E-1 is placed at a position away from the hypothetical line L1 to the negative direction of the X axis by ΔX1, and a feed point 122E-2 is placed at a position away from the hypothetical line L1 to the positive direction of the X axis by ΔX2 (<ΔX1). Note that the difference in distances between the two feed points and the hypothetical line L1 can be equal to or less than λ/20, where λ is the wavelength of a radio frequency signal.

As described above, relaxing the limitation on the arrangement of the feed points enables the improvement of flexibility in design and the reduction in production cost.

Note that the modification examples 1 and 2 described above are applicable to the embodiment 1 and embodiments 3 to 5, which will be described below, within the range that does not cause inconsistency.

Embodiment 3

In the embodiments 1 and 2, the configuration examples are described in which a radio wave having one type of polarization is radiated from the antenna module.

In the embodiments 3 and 4, examples are described in which a characteristic feature of the present application is applied to a dual-polarization type antenna module capable of radiating a radio wave having polarizations of two different types from the antenna module.

Figure 13A:
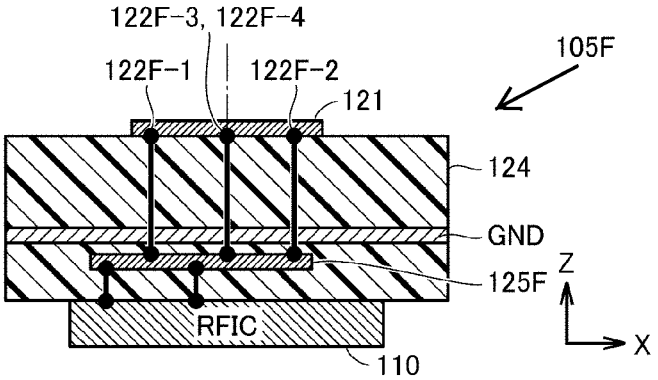
FIG. 13A is a cross-sectional view of an antenna device according to an embodiment 3.
Figure 13B:
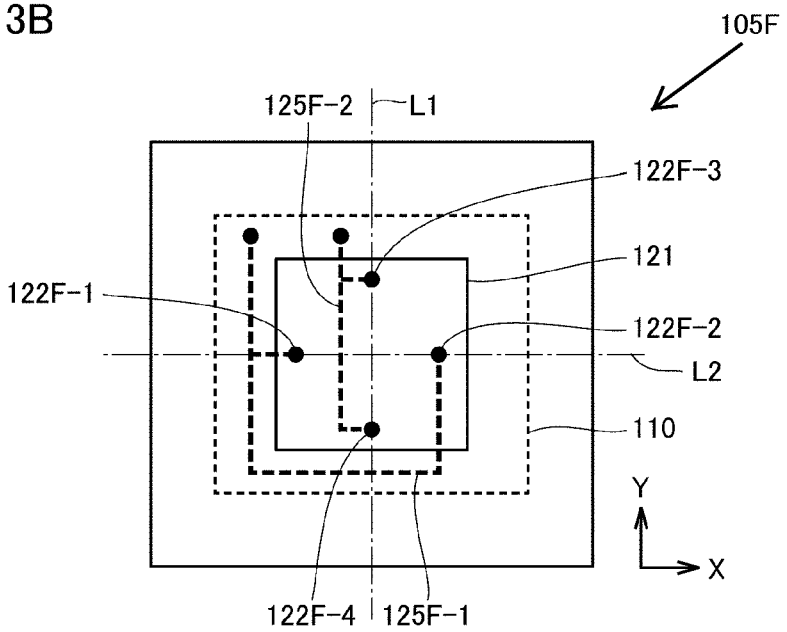
FIG. 13B is a plan view of the antenna device according to the embodiment 3.
Figure 14:
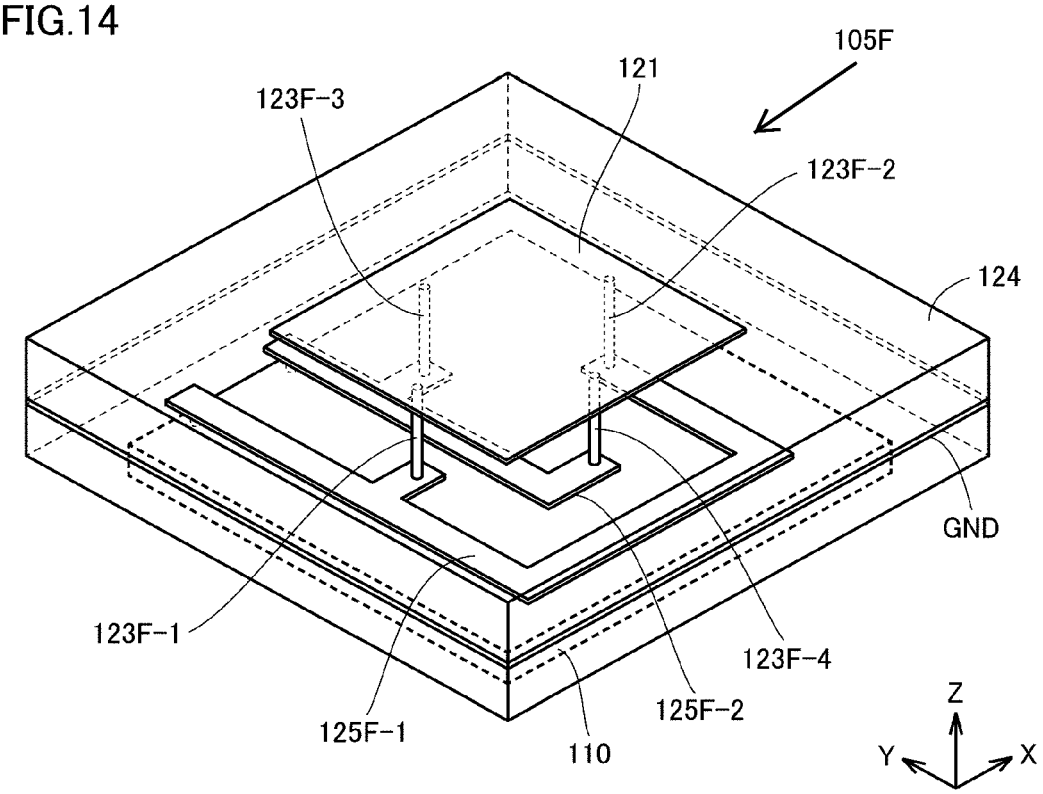
FIG. 14 is a perspective view of the antenna device of FIG. 13.

FIG. 13 includes a cross-sectional view (upper drawing) and a plan view (lower drawing) of an antenna device 105F according to the embodiment 3. FIG. 14 is a perspective view of the antenna device 105F.

Referring to FIG. 13, the antenna element 121 of the antenna device 105F is provided with feed points 122F-1, 122F-2, 122F-3, and 122F-4. The feed points 122F-1 and 122F-2 are each placed in such a manner as to be separated from the center of the antenna element 121 in the X axis direction by a substantially equal distance, and the feed points 122F-3 and 122F-4 are each placed in such a manner as to be separated from the center of the antenna element 121 in the Y axis direction by a substantially equal distance.

Based on radio frequency signals supplied to the feed points 122F-1 and 122F-2, a radio wave with a first polarization having an excitation direction along the X axis direction is radiated. Further, based on radio frequency signals supplied to the feed points 122F-3 and 122F-4, a radio wave with a second polarization having an excitation direction along the Y axis direction is radiated. That is to say, the first polarization and the second polarization are orthogonal to each other.

In this case, with regard to the first polarization, radio waves leaked from feed lines 123F-1 and 123F-2 connected to the feed points 122F-1 and 122F-2 can be similarly cancelled out by employing different line lengths in a wiring pattern 125F-1 on a phase difference formation plane 125F and causing radio frequency signals supplied to the feed points 122F-1 and 122F-2 to have substantially opposite phases. This enables to suppress the degradation of peak gain when the directivity is inclined.

Similarly, with regard to the second polarization, radio waves leaked from feed lines 123F-3 and 123F-4 can be similarly cancelled out by employing different line lengths in a wiring pattern 125F-2 and causing radio frequency signals supplied to the feed points 122F-3 and 122F-4 to have substantially opposite phases.

Note that in FIG. 13 and FIG. 14, as is the case with the embodiment 2, the examples are described in which the phase difference formation plane 125F is placed between the ground electrode GND and the RFIC 110. However, the configuration of the embodiment 3 is also applicable to the case where the phase difference formation plane 125F is placed between the antenna element 121 and the ground electrode GND as in the embodiment 1.

Embodiment 4

In the embodiment 3, the configuration is described in which the wiring pattern 125F-1 that forms the phase difference for the first polarization and the wiring pattern 125F-2 that forms the phase difference for the second polarization are formed on the same dielectric layer.

However, in the case where the phase difference formation planes for the respective polarizations are formed in the same layer, there is a possibility that these polarizations affect each other when these wiring patterns couple magnetically.

In the embodiment 4, a configuration is described in which in the dual-polarization type antenna device, isolation of these two polarizations is improved by forming a phase difference formation plane for a radio wave having the first polarization and a phase difference formation plane for a radio wave having the second polarization at different dielectric layers and by placing a ground layer in between these phase difference formation planes.

Figure 15A:
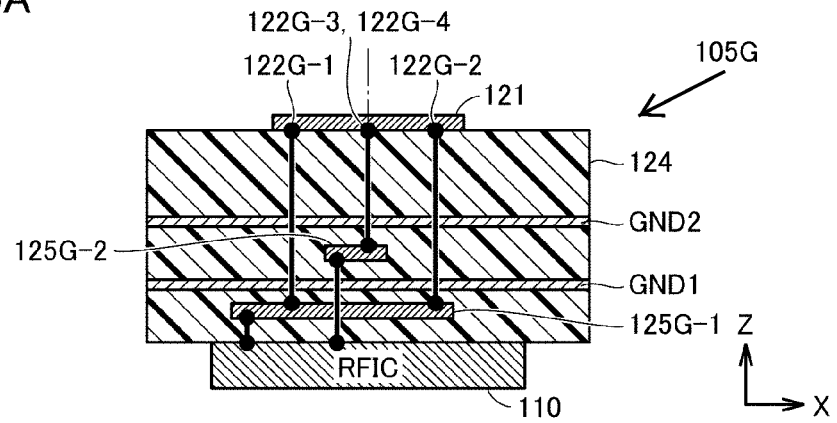
FIG. 15A is a cross-sectional view of an antenna device according to an embodiment 4.
Figure 15B:
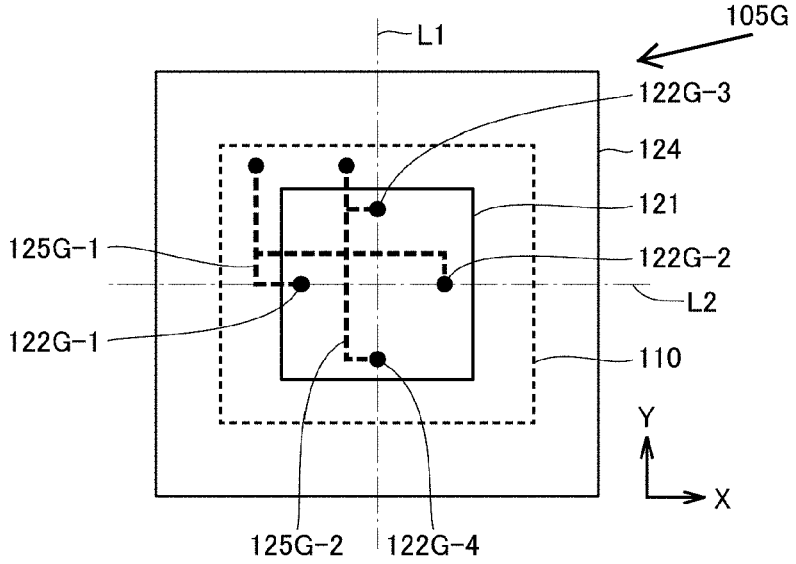
FIG. 15B is a plan view of the antenna device according to the embodiment 4.
Figure 16:
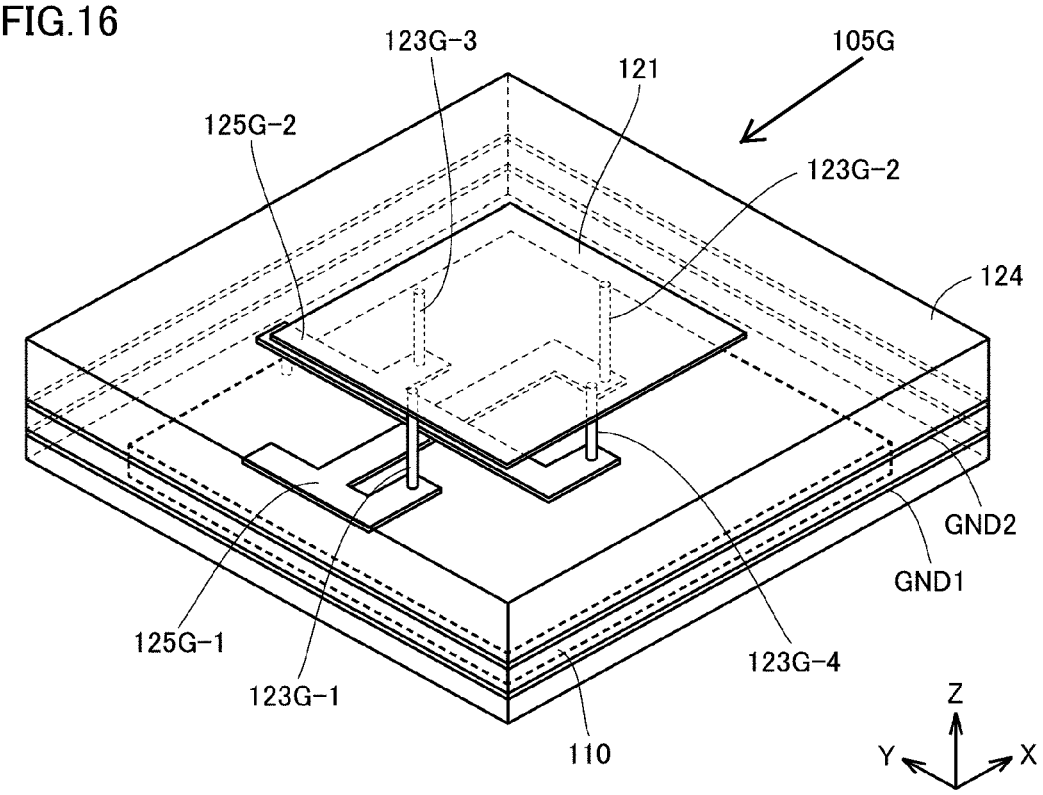
FIG. 16 is a perspective view of the antenna device of FIG. 15.

FIG. 15 includes a cross-sectional view (upper drawing) and a plan view (lower drawing) of an antenna device 105G according to the embodiment 4. FIG. 16 is a perspective view of the antenna device 105G.

Referring to FIG. 15, in the antenna device 105G, a phase difference formation plane 125G-1 is placed between a ground electrode GND1 and the RFIC 110. The phase difference formation plane 125G-1 is for a radio wave having the first polarization radiated via feed points 122G-1 and 122G-2, which are arranged in such a manner as to separate from each other in the X axis direction. Whereas, a phase difference formation plane 125G-2 is placed between the ground electrode GND1 and a ground electrode GND2. The phase difference formation plane 125G-2 is for a radio wave having the second polarization radiated via feed points 122G-3 and 122G-4, which are arranged in such a manner as to separate from each other in the Y axis direction. Note that the ground electrode GND2 is placed between the ground electrode GND1 and the antenna element 121.

With such configuration, the thickness of the dielectric substrate 124 becomes slightly thicker. However, the phase difference formation plane 125G-1 and the phase difference formation plane 125G-2 are insulated from each other with the ground electrode GND1. This enables to improve the isolation between the first polarization and the second polarization and improve the communication quality.

Embodiment 5

In the foregoing embodiments 1 to 4 and their modification examples, each has the configuration such that the feed line from the phase difference formation plane to the antenna element is formed linearly (in other words, the shortest distance). However, the feed line within the dielectric substrate is not necessarily arranged linearly.

Figure 17:
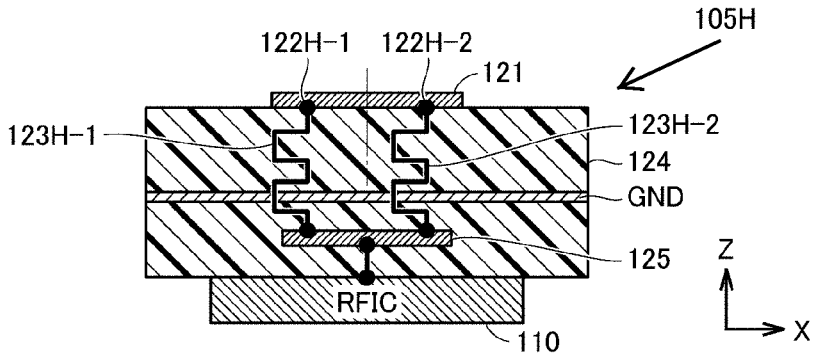
FIG. 17 is a cross-sectional view of an antenna device according to an embodiment 5.
Figure 18:
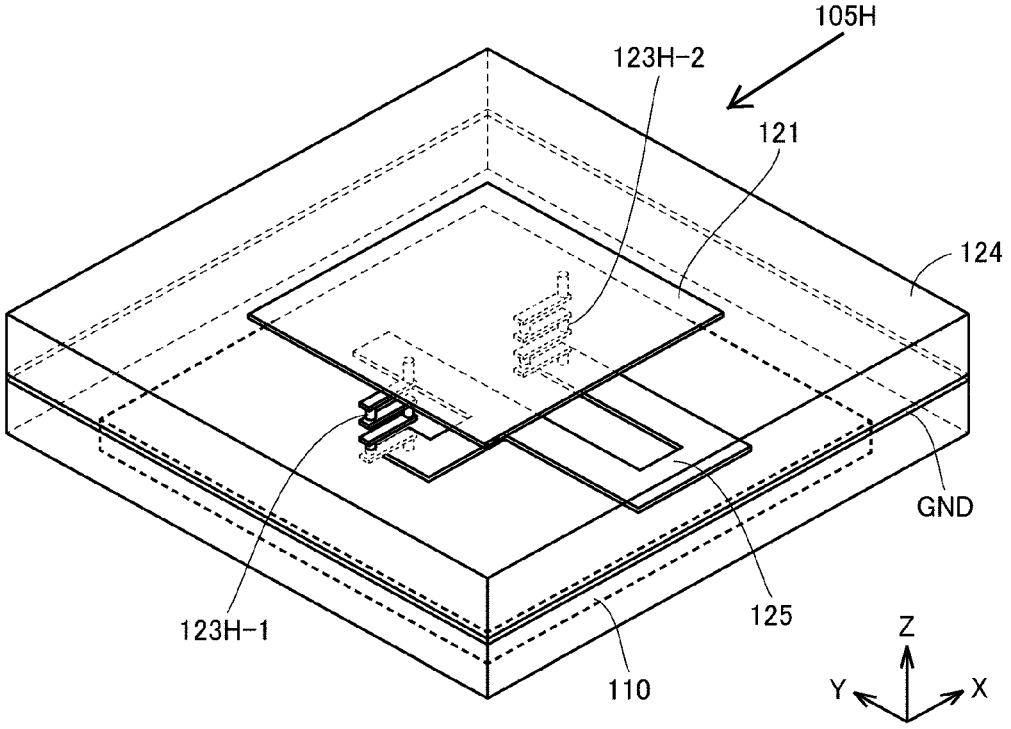
FIG. 18 is a perspective view of the antenna device of FIG. 17.

FIG. 17 and FIG. 18 are a cross-sectional view (FIG. 17) and a perspective view (FIG. 18) of an antenna device 105H according to the embodiment 5. The antenna device 105H has a configuration such that feed lines 123H-1 and 123H-2 from the phase difference formation plane 125 within the dielectric substrate 124 to the antenna element 121 are each formed in a meandering shape in which vias and wiring patterns are arranged in an alternating fashion.

The dielectric substrate 124 is formed of a multilayer substrate. In the case where the feed line is formed across a plurality of dielectric layers only using a linear via, depending on the process, the substrate thickness at a part where the via passes through may become thicker compared to the other part. This may cause distortion of the dielectric substrate 124 in some cases.

In such cases, the distortion of the dielectric substrate 124 can be reduced by forming the feed line by combining short vias and in-layer wiring patterns, as in the present embodiment 5, because the positions at which the vias are arranged can be dispersed in the plan view of the dielectric substrate 124.

Further, forming the feed line using vias and wiring patterns enables to secure the line length of the feed line, and further enables to adjust the inductance and conductance of the feed line based on their shapes. This enables to reduce the dimension of the antenna device in the thickness direction and contribute to the height reduction.

The embodiment 5 can be combined with the other embodiment. Note that in each of the embodiments described above, the example is described in which the phase difference of radio frequency signals supplied to two feed points is adjusted by varying the line lengths of the feed lines. However, the adjustment of the phase difference may be achieved using a technique other than the use of the line lengths. For example, the phase difference may be adjusted by forming a LC circuit using a wiring pattern and an electrode placed inside the dielectric substrate.

Embodiment 6

In each of the embodiments described above, the configuration is described in which the feed lines, which supply radio frequency signals having phases opposite to each other to the two feed points, have been divided on the phase difference formation plane. In the embodiment 6, a configuration is described in which a feed line that supplies a radio frequency signal to one of feed points is formed as a "coupled line" that electromagnetically couples with a feed line that supplies a radio frequency signal to the other feed point. That is to say, in the embodiment 6, the feed lines supplying radio frequency signals having phases opposite to each other to the two feed points have been divided using the "coupled line".

Figure 19:
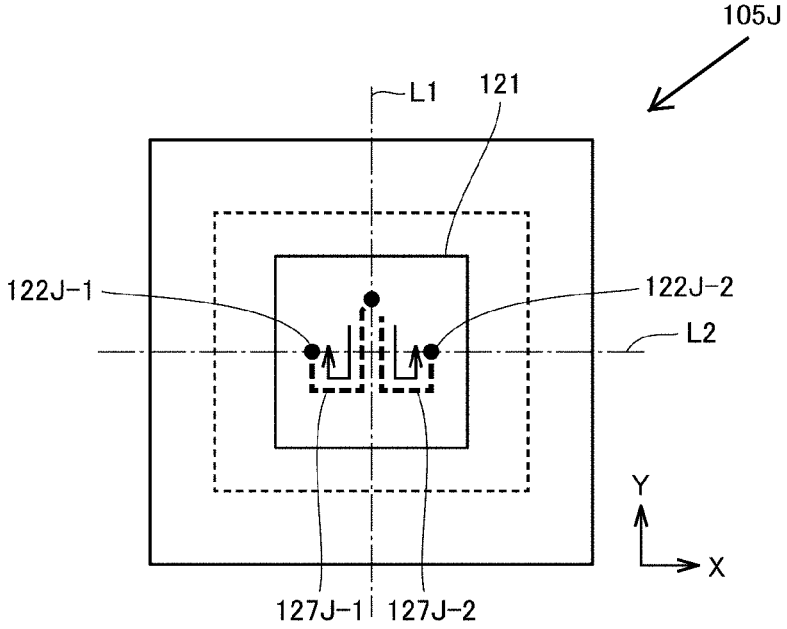
FIG. 19 is a plan view of an antenna device according to an embodiment 6.
Figure 20:
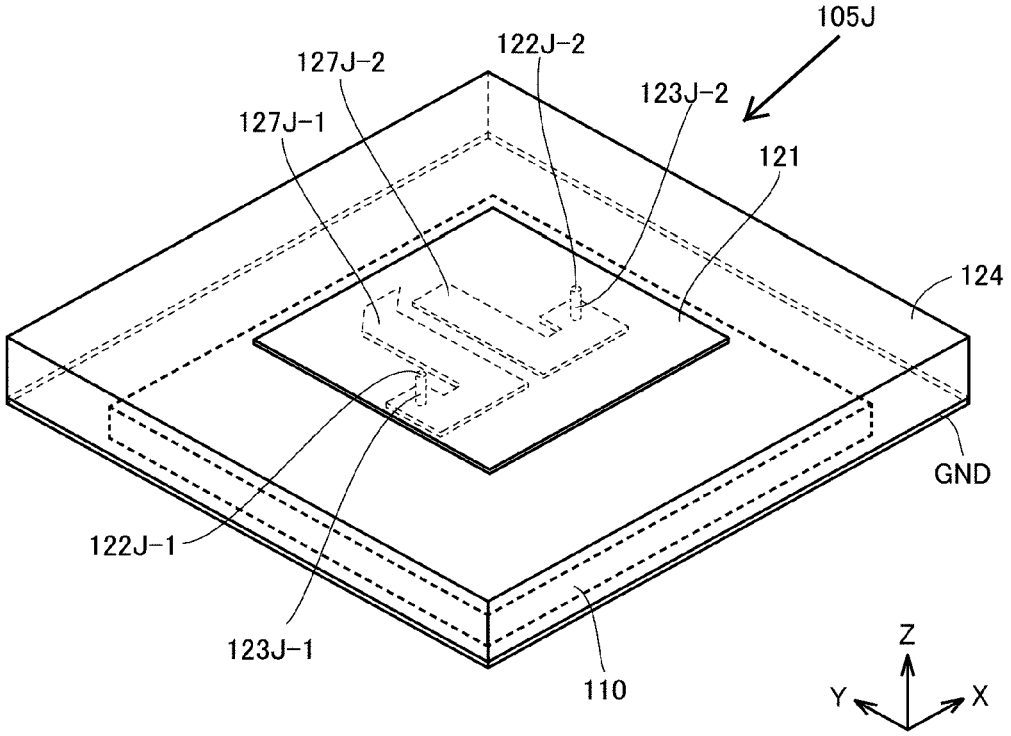
FIG. 20 is a perspective view of the antenna device of FIG. 19.

FIG. 19 is a plan view of an antenna device 105J according to the embodiment 6, and FIG. 20 is a perspective view of the antenna device 105J. FIG. 19 and FIG. 20 are diagrams correspond to FIG. 5B and FIG. 6 in the embodiment 1.

Referring to FIG. 19 and FIG. 20, in the antenna device 105J, a radio frequency signal from the RFIC 110 is transmitted to a feed point 122J-1 of the antenna element 121 via a feed line 127J-1 (first line) and a feed line (via) 123J-1.

Further, in the dielectric substrate 124, a feed line 127J-2 (second line) is formed on the layer on which the feed line 127J-1 is formed. One end portion of the feed line 127J-2 is in open state, and the other end portion is connected to a feed point 122J-2 of the antenna element 121 via a feed line (via) 123J-2. The feed line 127J-1 and the feed line 127J-2 have, along their paths, parallel parts adjacent to each other. In the example of FIG. 19, the feed line 127J-1 and the feed line 127J-2 are arranged next to each other in parallel at part extending along the hypothetical line L1 from the via that stands up from the RFIC110.

When a radio frequency signal is supplied to the feed line 127J-1, an electromagnetic field is generated around the feed line 127J-1 in association with the supplying of the radio frequency signal. In the parallel paths described above, a radio frequency signal similar to that of the feed line 127J-1 is transmitted through the feed line 127J-2, which is not connected to the RFIC 110 because of electromagnetic coupling established between the feed line 127J-1 and the feed line 127J-2. In the signal transmitting in such electromagnetic coupling, it is known that the phase of a signal being transmitted is reversed. That is to say, the phase of a radio frequency signal being transmitted to the feed point 122J-1 via the feed line 127J-1 and the phase of a radio frequency signal being transmitted to the feed point 122J-2 via the feed line 127J-2 are opposite to each other. Accordingly, in the antenna device 105J illustrated in FIG. 19 and FIG. 20, radio frequency signals having opposite phases other can be transmitted to two feed points while setting the line lengths of two feed lines, the feed line 127J-1 and the feed line 127J-2, to substantially the same lengths.

This enables to reduce the area of the wiring pattern formed within the dielectric substrate and contribute to the reduction of production cost, compared to the configuration in which the two feed lines have different line lengths as in the embodiment 1.

Modification Example

Figure 21:
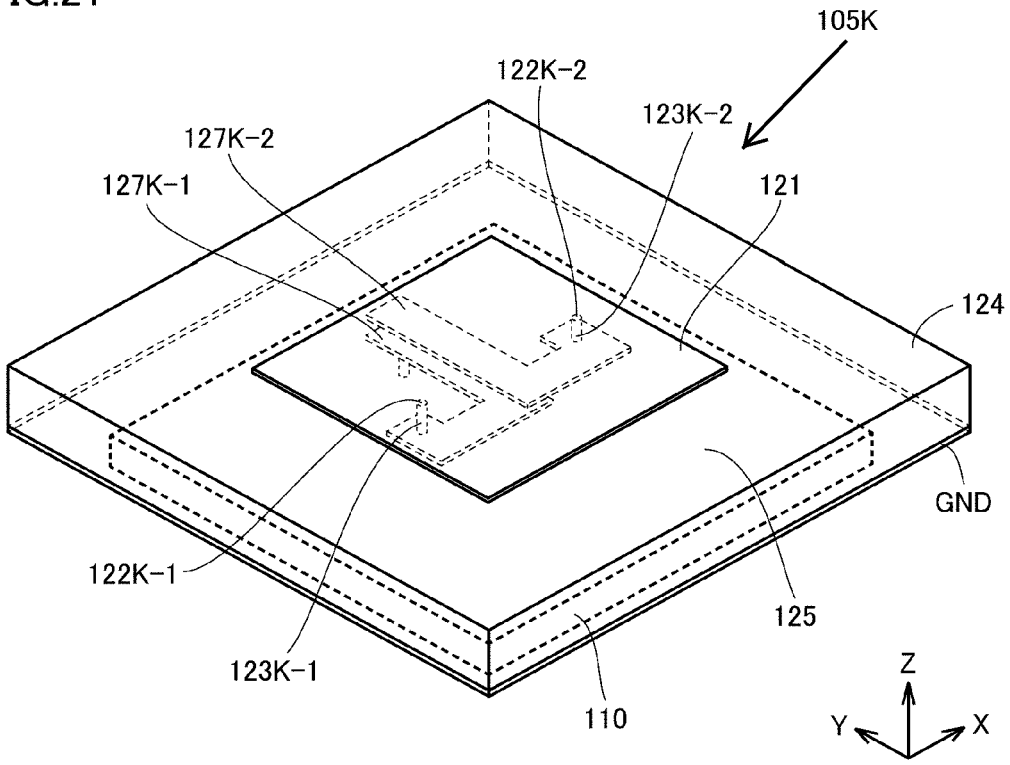
FIG. 21 is a perspective view of an antenna device according to a modification example of the embodiment 6.

FIG. 21 is a perspective view of an antenna device 105K according to a modification example of the embodiment 6. In the antenna device 105K, a feed line 127K-1 that transmits a radio frequency signal to a feed point 122K-1 and a feed line 127K-2 that transmits a radio frequency signal to a feed point 122K-2 are formed on different layers of the dielectric substrate 124. One end portion of the feed line 127K-2 is connected to the feed point 122K-2 via a feed line (via) 123K-2, and the other end portion of the feed line 127K-2 is not connected to any component electrically and is in open state.

Further, in the plan view of the antenna device 105K from a direction normal to the dielectric substrate 124, the feed line 127K-2 is arranged in such a way that part of the feed line 127K-1 and part of the feed line 127K-2 are in parallel and overlap each other. Even in such a configuration, a signal having the phase opposite to that of a radio frequency signal being transmitted to the feed line 127K-1 is generated in the feed line 127K-2 due to the electromagnetic coupling between the feed line 127K-1 and the feed line 127K-2.

According to this, in the antenna device 105K, radio frequency signals having opposite phases can be similarly transmitted to two feed points while setting the line lengths of two feed lines, the feed line 127K-1 and the feed line 127K-2, to substantially the same length. Accordingly, this enables to reduce the area of the wiring pattern formed within the dielectric substrate and contribute to the reduction of production cost.

Note that in the embodiment 6 and the modification example thereof illustrated in FIG. 19 to FIG. 21, the configurations are described in which a radio wave radiated from the antenna module has one type of polarization. However, these configuration are also applicable to the dual-polarization type antenna modules described in the embodiments 3 and 4.

It is to be understood that the embodiments described in the present disclosure are exemplary in all aspects and are not restrictive. It is intended that the scope of the present disclosure is determined by the claims, not by the description of the embodiments described above, and includes all variations which come within the meaning and range of equivalency of the claims.

REFERENCE SIGNS LIST

10 Communication device
100 Antenna module
105, 105A-105H, 105J, 105K Antenna device
111A-111D, 113A-113D, 117 Switch
112AR-112DR Low noise amplifier
112AT-112DT Power amplifier
114A-114D Attenuator
115A-115D Phase shifter
116 Signal multiplexer/demultiplexer
118 Mixer
119 Amplifier circuit
120 Antenna array
121, 121C Antenna element
123, 123A-123H, 123J, 123K, 127J, 127K Feed line
122, 122A-122G Feed point
124 Dielectric substrate
125, 125F, 125G Phase difference formation plane
126 Parasitic element
200 BBIC
GND, GND1, GND2 Ground electrode
L1, L2 Hypothetical line.

The invention claimed is:

1. An antenna module comprising:
a radio frequency processing circuit;
a plurality of antenna devices, each of the plurality of antenna devices comprising:
a dielectric substrate;
an antenna on the dielectric substrate; and
a first feed line configured to transmit a radio frequency signal from the radio frequency processing circuit to the antenna, wherein:
the first feed line comprises a first branch line and a second branch line within the dielectric substrate, the first and second branch lines being connected at a first branch point,
the first branch line is configured to transmit the radio frequency signal to a first feed point of the antenna,
the second branch line is configured to transmit the radio frequency signal to a second feed point of the antenna, and
a phase of the radio frequency signal at the first feed point and a phase of the radio frequency signal at the second feed point are substantially opposite to each another, and
wherein as seen in a plan view of the antenna device, the radio frequency processing circuit and at least one antenna of the plurality of antenna devices overlap.

2. An antenna module comprising:
a plurality of antenna devices, each of the plurality of antenna devices comprising:
a dielectric substrate;
an antenna on the dielectric substrate;
a ground electrode; and
a first feed line configured to transmit a radio frequency signal from a radio frequency processing circuit to the antenna, wherein:
the first feed line comprises a first branch line and a second branch line within the dielectric substrate, the first and second branch lines being connected at a first branch point,
the first branch line is configured to transmit the radio frequency signal to a first feed point of the antenna,
the second branch line is configured to transmit the radio frequency signal to a second feed point of the antenna,
a phase of the radio frequency signal at the first feed point and a phase of the radio frequency signal at the second feed point are substantially opposite to each another,
at least a portion of the dielectric substrate is between the antenna and the ground electrode,
the first branch point is closer to the antenna than the ground electrode, and
a length of the first feed line from the radio frequency processing circuit to the first feed point is different than a length of the first feed line from the radio frequency processing circuit to the second feed point.

3. An antenna module comprising:
a plurality of antenna devices, each of the plurality of antenna devices comprising:
a dielectric substrate;
an antenna on the dielectric substrate;
a ground electrode; and
a first feed line configured to transmit a radio frequency signal from a radio frequency processing circuit to the antenna, wherein:
the first feed line comprises a first branch line and a second branch line within the dielectric substrate, the first and second branch lines being connected at a first branch point,
the first branch line is configured to transmit the radio frequency signal to a first feed point of the antenna,
the second branch line is configured to transmit the radio frequency signal to a second feed point of the antenna,
a phase of the radio frequency signal at the first feed point and a phase of the radio frequency signal at the second feed point are substantially opposite to each another,
at least a portion of the dielectric substrate being between the antenna and the ground electrode, the first branch point is further away from the antenna than the ground electrode, and a length of the first feed line from the radio frequency processing circuit to the first feed point is different than a length of the first feed line from the radio frequency processing circuit to the second feed point.

4. The antenna module according to claim 1, wherein as seen in the plan view of the antenna device, the first feed point and the second feed point are arranged symmetrically with respect to a first center line of the antenna.

5. The antenna module according to claim 4, wherein:

each of the antenna devices further comprises:

a third feed point and a fourth feed point; and a second feed line configured to transmit the radio frequency signal from the radio frequency processing circuit to the third feed point and the fourth feed point, as seen in the plan view, the third feed point and the fourth feed point are arranged symmetrically with respect to a second center line of the antenna, the second center line being orthogonal to the first center line, and a line length of the second feed line from the radio frequency processing circuit to the third feed point is different than a line length of the second feed line from the radio frequency processing circuit to the fourth feed point.

6. The antenna module according to claim 5, wherein:

the first branch point is at a first layer of the dielectric substrate, the second feed line comprises a third branch line and a fourth branch line connected at a second branch point, the second branch point being at a second layer of the dielectric substrate, and each of the plurality of antenna devices further comprises a second ground electrode between the first layer and the second layer.

7. The antenna module according to claim 1, wherein:

the antenna is inside the dielectric substrate, and each of the plurality of antenna devices further comprises a parasitic element, the parasitic element being closer to a surface of the dielectric substrate than the antenna.

8. The antenna module according to claim 1, wherein the second feed line is further configured to receive the radio frequency signal from the first feed line by electromagnetic coupling with the first feed line within the dielectric substrate.

9. The antenna module according to claim 2, wherein as seen in a plan view of the antenna device, the first feed point and the second feed point are arranged symmetrically with respect to a first center line of the antenna.

10. The antenna module according to claim 3, wherein as seen in a plan view of the antenna device, the first feed point and the second feed point are arranged symmetrically with respect to a first center line of the antenna.

11. The antenna module according to claim 9, wherein:

each of the antenna devices further comprises:

a third feed point and a fourth feed point; and a second feed line configured to transmit the radio frequency signal from the radio frequency processing circuit to the third feed point and the fourth feed point, as seen in the plan view, the third feed point and the fourth feed point are arranged symmetrically with respect to a second center line of the antenna, the second center line being orthogonal to the first center line, and a line length of the second feed line from the radio frequency processing circuit to the third feed point is different than a line length of the second feed line from the radio frequency processing circuit to the fourth feed point.

12. The antenna module according to claim 10, wherein:

each of the antenna devices further comprises:

a third feed point and a fourth feed point; and a second feed line configured to transmit the radio frequency signal from the radio frequency processing circuit to the third feed point and the fourth feed point, as seen in the plan view, the third feed point and the fourth feed point are arranged symmetrically with respect to a second center line of the antenna, the second center line being orthogonal to the first center line, and a line length of the second feed line from the radio frequency processing circuit to the third feed point is different than a line length of the second feed line from the radio frequency processing circuit to the fourth feed point.

13. The antenna module according to claim 11, wherein:

the first branch point is at a first layer of the dielectric substrate, the second feed line comprises a third branch line and a fourth branch line connected at a second branch point, the second branch point being at a second layer of the dielectric substrate, and each of the plurality of antenna devices further comprises a second ground electrode between the first layer and the second layer.

14. The antenna module according to claim 12, wherein:

the first branch point is at a first layer of the dielectric substrate, the second feed line comprises a third branch line and a fourth branch line connected at a second branch point, the second branch point being at a second layer of the dielectric substrate, and each of the plurality of antenna devices further comprises a second ground electrode between the first layer and the second layer.

15. The antenna module according to claim 2, wherein:

the antenna is inside the dielectric substrate, and each of the plurality of antenna devices further comprises a parasitic element, the parasitic element being closer to a surface of the dielectric substrate than the antenna.

16. The antenna module according to claim 3, wherein:

the antenna is inside the dielectric substrate, and each of the plurality of antenna devices further comprises a parasitic element, the parasitic element being closer to a surface of the dielectric substrate than the antenna.

17. The antenna module according to claim 2, wherein:

the second feed line is further configured to receive the radio frequency signal from the first feed line by electromagnetic coupling with the first feed line within the dielectric substrate.

18. The antenna module according to claim 3, wherein:

the second feed line is further configured to receive the radio frequency signal from the first feed line by electromagnetic coupling with the first feed line within the dielectric substrate.

* * * * *